United States Patent [19]

Legardinier

[11] 4,372,208

[45] Feb. 8, 1983

[54] DEVICE FOR SUPPLYING WITH INK PRINTING APPARATUS FOR CIGARETTE-MAKING MACHINES

[75] Inventor: André Legardinier, Plessis-Bouchard, France

[73] Assignee: Decoufle S.A.R.L., Paris, France

[21] Appl. No.: 249,913

[22] Filed: Apr. 1, 1981

[30] Foreign Application Priority Data

Apr. 1, 1980 [FR] France ..... 80 07314

[51] Int. Cl.[3] ..... B41F 31/08

[52] U.S. Cl. ..... 101/366; 417/395

[58] Field of Search ..... 101/366, 365, 148; 417/395, 384, 394, 398; 92/13.2; 91/52; 137/512.15

[56] References Cited

U.S. PATENT DOCUMENTS

| | | | |
|---|---|---|---|
| 2,018,111 | 10/1935 | Babitch | 417/470 |
| 2,494,529 | 1/1950 | Wirtanen | 417/395 |
| 2,753,804 | 7/1956 | Goss | 417/395 |
| 2,941,467 | 6/1960 | Jauch et al. | 101/366 |
| 3,134,326 | 5/1964 | Davis | 101/366 |
| 3,194,155 | 7/1965 | Davis, Jr. | 101/366 |
| 3,299,826 | 1/1967 | Williams | 417/395 |
| 3,345,943 | 10/1967 | Rakowicz et al. | 101/366 |
| 3,619,328 | 11/1971 | Preston | 131/69 X |
| 3,804,012 | 4/1974 | Bosshardt | 101/366 |
| 3,816,034 | 6/1974 | Rosenquest, Jr. | 417/395 |
| 3,949,669 | 4/1976 | Farrow et al. | 101/366 |
| 3,983,900 | 10/1976 | Airhart | 137/512.15 X |

FOREIGN PATENT DOCUMENTS

| | | |
|---|---|---|
| 392587 | 3/1924 | Fed. Rep. of Germany . |
| 2642658 | 3/1977 | Fed. Rep. of Germany . |
| 293984 | 7/1928 | United Kingdom . |
| 1296472 | 11/1972 | United Kingdom . |

*Primary Examiner*—J. Reed Fisher

[57] ABSTRACT

This device consists of a pump which delivers ink from a tube of ink to a reservoir device of the apparatus called ink trough, this tube of ink being tightly fitted to a first bore of the pump, and a duct, one end of which is tightly fitted to a second bore of the pump, connecting this latter to the ink trough.

It is characterized in that said pump (10) is a membrane pump, controlled by compressed air, and in that said membrane (11) is clamped between two casings (13, 14), the first casing (13), in which are provided the first bore (15) and the second bore (16), providing the circuit for the ink and containing for this purpose a plate (20) which forms the seat for a suction valve (21) and a delivery valve (22), the plate (20) defining with the walls of the casing (13) and the membrane (11) a chamber (29) which, when the pump (10) is primed, will be constantly filled with ink, and the second casing (14) providing the pneumatic circuit and containing for this purpose a piston (35) which is applied against the membrane (11) and made integral therewith.

Specially designed with respect to the physical characteristics of the ink used as well as the small quantities to be transferred, this device requires no maintenance or emptying. The tube of ink is screwed to a bore of the pump inside which the ink, sheltered from the air, does not dry, even during long shut-down periods of the cigarette-making machine.

3 Claims, 3 Drawing Figures

DEVICE FOR SUPPLYING WITH INK PRINTING APPARATUS FOR CIGARETTE-MAKING MACHINES

BACKGROUND OF THE INVENTION

Cigarette-making machines are equipped with printing apparatus for affixing to the cigarettes the stamps representing their specific trademarks.

The ink used is of a very pasty consistence and is then in tubes; it dries very quickly in the air forming a surface crust. Moreover, the quantities of ink required are very small. This is why the ink reservoirs in these printing apparatus are of very small capacity.

Up to present, these ink reservoirs or boxes were filled by hand, for example every hour and, if the ink started to dry out, it had to be stirred with a wooden spatula.

The Applicant has sought to suppress this manual operation which could cause errors, either by forgetting to fill the ink box or by filling it too full, this ink drying first of all on the surface, then in depth.

SUMMARY OF THE INVENTION

The device forming the object of the present invention provides for an automatic supply of the ink reservoir and presents the complementary advantages of requiring no maintenance, no emptying and of avoiding ink losses.

It consists of a pump which feeds the ink from an ink tube to a reservoir device of the apparatus called ink trough, this tube of ink fitting tightly in a first bore of the pump, and a duct, whose end fits tightly to a second bore of the pump, connecting this latter to the ink trough and it is essentially characterized in that said pump is a membrane pump, driven by compressed air, and in that said membrane is held firmly between two casings, the first casing, in which are provided the first bore and the second bore, providing the circuit for the ink and containing for this purpose a plate which forms the seat for a suction valve and for a delivery valve, the plate defining with the walls of the casing and the membrane a chamber which, when the pump is primed, will be constantly filled with ink, and the second casing providing the pneumatic circuit and containing for this purpose a piston which is applied against the membrane and made integral therewith.

The tube of ink is screwed to a bore of the pump inside which the ink, screened from the air, does not dry even during long shut-down periods of the cigarette-making machine.

DESCRIPTION OF THE DRAWINGS

There will be described in more detail hereafter, by way of indication in no wise limiting, a particular embodiment of the device of the present invention as well as the operation thereof, with reference to the accompanying drawing in which.

DESCRIPTION OF THE PREFERRED EMBODIMENT

Figure 1:
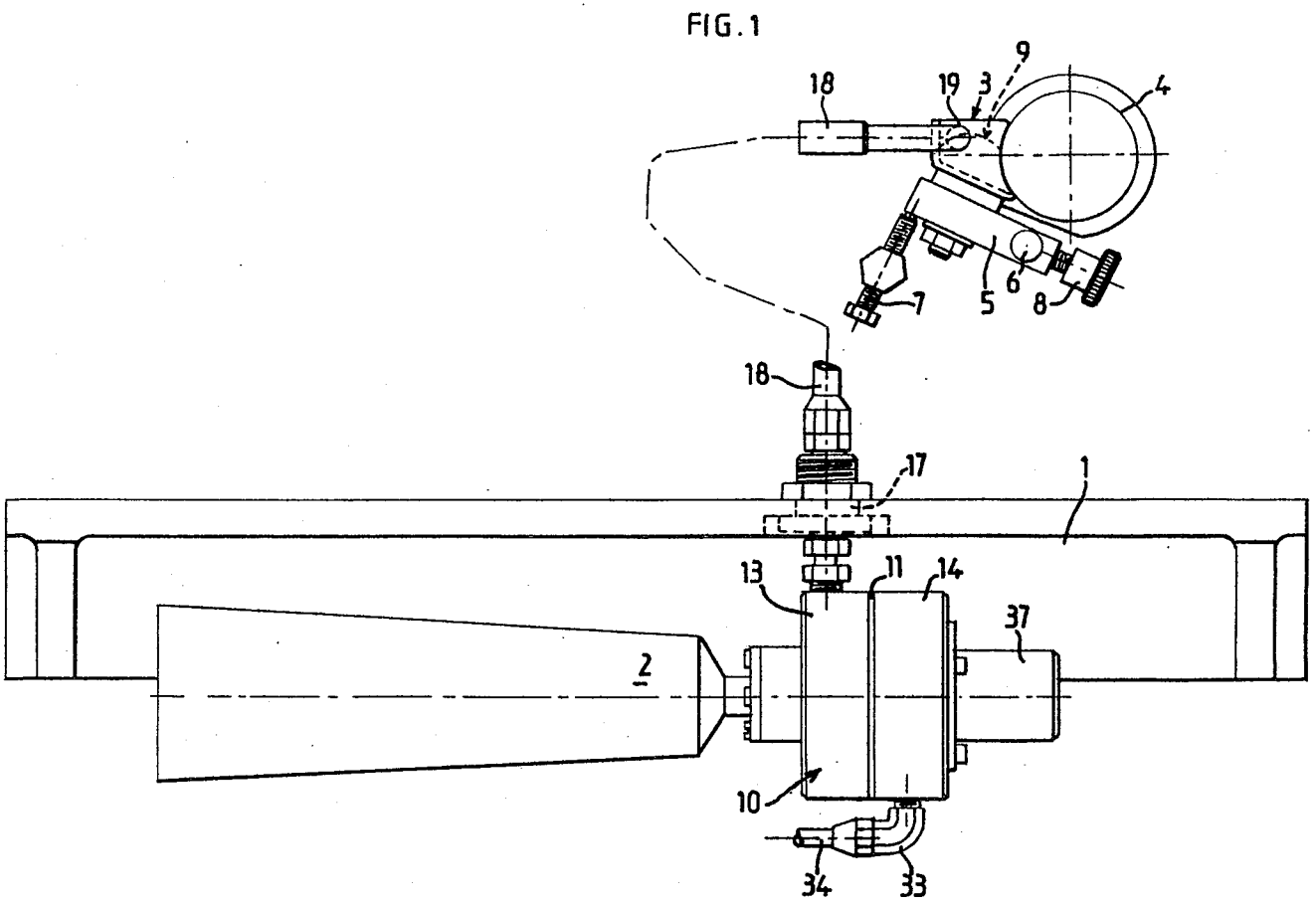
FIG. 1 is a simplified schematical view in elevation of this device installed on the frame of the cigarette-making machine.

The device shown in FIG. 1, mounted on a support-plate 1, which will itself be installed on the frame of the cigarette-making machine, enables the reservoir device 3 of the printing apparatus of this machine to be automatically supplied from an ink tube 2. From this reservoir device 3, called ink trough, the ink is taken up by a rotary cylinder 4.

The ink trough 3, of a known structure, is a low-capacity receptacle, with a sloping bottom, open on one side so as to be able to bear against cylinder 4. It is supported by a part 5 pivotable about a shaft 6 and its operating position may be adjusted by means of screw 7. It is then locked in the desired position by means of locking screw 8.

The viscosity of the ink used for cigarettes is such that, during operation of the machine, its surface 9 assumes, in the ink trough, a convex form.

The device for supplying ink trough 3, which forms the subject matter of the present invention, consists of a pneumatically controlled membrane pump 10 specially designed with respect to the physical characteristics of the ink used as well as the small quantities to be transmitted.

Figure 2:
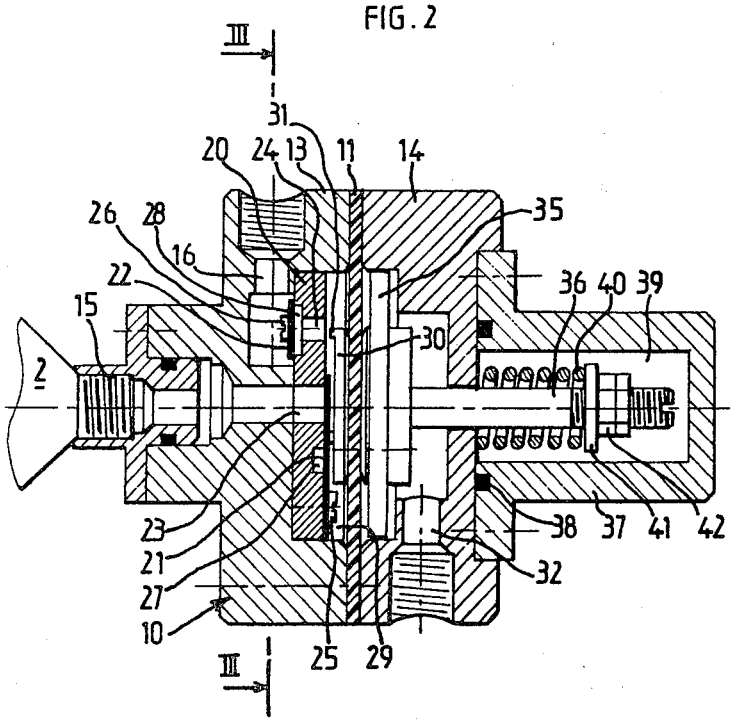
FIG. 2 is an enlarged view in longitudinal section of the ink pump.

As can be seen in FIG. 2, membrane 11 of pump 10 is clamped by means of screws 12 (FIG. 3) between two casings 13 and 14, which provide respectively the ink circuit and the pneumatic control circuit. Membrane 11 is made from rubber providing a perfect seal.

Casing 13 comprises an input bore 15 screw-tapped so as to be able to receive the threaded neck of tube 2, as well as an output bore 16 to which there is fitted, by means of a connection 17 (FIG. 1), a flexible pipe 18 shown partially in this Figure, connecting pump 10 to the ink trough 3 apertured at 19 for this purpose.

Inside casing 13 there is fixed a plate 20 which forms the seat for two valves disposed in perpendicular directions, suction valve 21 and delivery valve 22. These valves 21, 22, able to close off the orifices 23, 24 provided in plate 20 corresponding respectively to the ink input and output bores 15, 16, are fixed to plate 20, respectively by screws 25, 26.

Figure 3:
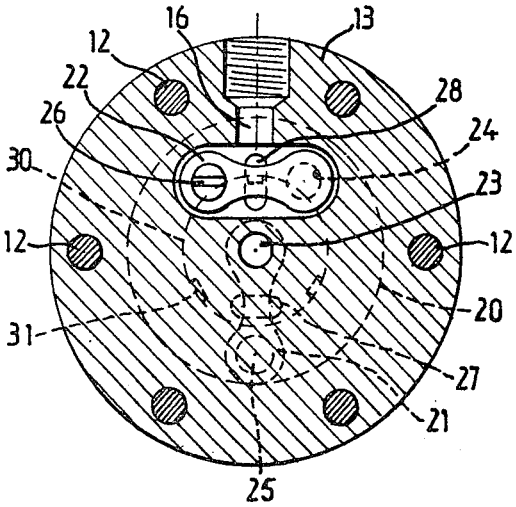
FIG. 3 is a sectional view along line III—III of FIG. 2.

Preferably, the membranes of valves 21, 22 made from very flexible spring steel will have a bilobate form (FIG. 3).

Furthermore, there will be advantageously provided in plate 20, behind each of valves 21, 22, cavities bearing the respective reference FIGS. 27, 28 forming outlets for the ink which remains between plate 20 and said valves, during operation of the pump. Thus, the valves will be able to lie flat against part 20, thus ensuring correct performance of pump 10.

Plate 20 defines, with the walls of casing 13 and membrane 11, a chamber 29 which, when pump 10 is primed, will be constantly filled with ink.

On membrane 11 there is applied the back-plate 30 of the control piston which will be described further on. According to a preferred embodiment, this back-plate 30 carries protuberances 31 (for example three disposed at 120°) which avoid the suction-cup phenomenon at delivery, between it and valve 21. Protuberances 31 serve as a bearing means on plate 20 for freeing more rapidly back-plate 30 and therefore valve 21 during the suction stroke. Valve 21 is then never hindered in its operation.

Casing 14 comprises a bore 32 to which is fitted, by means of a connection 33, tube 34 for the intake of compressed air coming from the pneumatic distributor.

Inside casing 14 there is housed a piston 35 which is applied against membrane 11 and made integral therewith by securing with screws to back-plate 30. Rod 36 of piston 35 extends outside casing 14, where it is protected by a cap 37 screwed onto casing 14 with an annular seal 38 placed therebetween.

In chamber 39 defined by cap 37, there is disposed a return spring 40 around the piston rod 36, this spring 40 bearing at one end against the wall of casing 14 limiting chamber 39 and at the other end against the base 41 of an adjusting nut 42.

Since the amount of ink used depends on the number of cigarettes, control of the pump is slaved electrically to the number of cigarettes produced, recorded by a counter, and is then independent of the shutdown times of the machine. This counter actuates a conventional control electromagnetic valve, not shown.

The device of the present invention operates in the following way:

On the delivery stroke, the compressed air arrives through orifice 32 and drives back piston 35 and membrane 11. The pressure of the ink contained in chamber 29 closes valve 21 and opens valve 22. The ink flows through orifice 16. This automatic supply is maintained for a very short period of time (10 seconds for example), the piston travelling in the case of the device shown in the drawings, for a distance of 1 mm and the flow rate of the ink being 1 $cm^2$ for each pulse.

On the suction stroke, since the control of the piston is stopped, membrane 11 is pushed back under the effect of spring 40. The depression thus formed pushes down valve 22 and frees valve 21; the ink is then sucked into chamber 29 through orifice 15.

An ink should be used having a viscosity such that it is sufficiently soft to pass normally through pump 10 and to spread out suitably in ink trough 3.

The empty ink trough may be filled by hand. After each pulse, it will be necessary to wait for a few seconds to give spring 40 time to urge back membrane 11 and to suck the ink from tube 2.

When the machine operates to produce cigarettes, which is controlled by the rolling cell and by the counting device, a counter triggers off regularly automatic injection of ink into ink trough 3, at adjustable time intervals, depending on the number of cigarettes produced.

In the case of faulty operation, the tube of ink should be checked, changed if necessary and the ink level in the ink trough restored by hand. Faulty operation of the pump 10 may be due to the presence of air in tube 2.

It will of course be understood that the embodiment of the device of the present invention which has been described above with reference to the accompanying drawing has been given by way of indication and is in no wise limiting, and that modifications may be made without departing from the scope and spirit of the present invention. This device, of compact form could furthermore be used for other purposes, for pumping other substances having similar consistency, i.e. pasty. All that would be required would be to make thereto the necessary adaptations which would then be within the scope of a man skilled in the art.

What is claimed is:

1. An inking device for a printer of a cigarette making machine comprising a diaphragm pump including a pair of casing members having a membrane secured therebetween, one of said casing members having an inlet bore and an outlet bore, an ink containing tube secured in said inlet bore, a flexible conduit having one end secured to said outlet bore and the other end to said printer, a plate positioned in said one of said casing members in spaced parallel relation to said membrane and defining therewith a chamber, said plate having a first orifice therein communicating with said inlet bore and said chamber and a second orifice communicating with said chamber and said outlet bore, valve members secured to opposite faces of said plate for controlling said orifices and the flow of ink to and from said chamber with respect to said bores, said second casing member having a piston and piston rod therein, said piston secured to said membrane, said inlet bore and said first orifice and said piston rod being positioned on a common axis with the axis of said outlet bore being disposed in a plane normal to said common axis, a bore in said second casing member connected to a source of compressed air for moving said piston and membrane towards said plate and a return spring connected to said piston rod.

2. A device as claimed in claim 1 wherein said plate is formed with cavities adjacent said orifices and valve members and constituting outlets for the ink remaining between said plate and valve members upon the seating of the valve members on said plate.

3. A device as claimed in claim 1 wherein said membrane is clamped between said piston and a backing plate member with said backing plate member having a plurality of spaced protuberances thereon for engaging said plate.

* * * * *